US009450336B2

(12) United States Patent
Wu

(10) Patent No.: US 9,450,336 B2
(45) Date of Patent: Sep. 20, 2016

(54) ELECTRICAL CONNECTOR AND COMBINATION OF AN ELECTRONIC DEVICE AND THE ELECTRICAL CONNECTOR

(71) Applicant: Wistron Corporation, New Taipei (TW)

(72) Inventor: Hui-Wen Wu, New Taipei (TW)

(73) Assignee: Wistron Crop., Hsinchu (TW)

( * ) Notice: Subject to any disclaimer, the term of this patent is extended or adjusted under 35 U.S.C. 154(b) by 0 days.

(21) Appl. No.: 14/792,131

(22) Filed: Jul. 6, 2015

(65) Prior Publication Data

US 2016/0064861 A1 Mar. 3, 2016

(30) Foreign Application Priority Data

Sep. 3, 2014 (TW) ..... 103215735 U

(51) Int. Cl.
*H01R 13/627* (2006.01)
*H01R 13/639* (2006.01)

(52) U.S. Cl.
CPC ..... *H01R 13/639* (2013.01)

(58) Field of Classification Search
CPC ..... H01R 13/6271; H01R 13/6272
USPC ..... 439/357, 929, 383
See application file for complete search history.

(56) References Cited

U.S. PATENT DOCUMENTS 3,201,740 A * 8/1965 Rubens ..... H01R 13/447 174/67
3,543,218 A * 11/1970 Archer ..... H01R 13/20 439/345
3,678,441 A * 7/1972 Upstone ..... H01R 13/523 439/272
4,293,173 A * 10/1981 Tricca ..... H01R 13/443 174/67
4,675,779 A * 6/1987 Neuwirth ..... H01T 4/06 174/564
4,917,625 A * 4/1990 Haile ..... H01R 13/6392 439/271
5,993,240 A * 11/1999 Schaefer ..... H01R 13/6215 439/352

* cited by examiner

*Primary Examiner* — Phuong Dinh
(74) *Attorney, Agent, or Firm* — Brinks Gilson & Lione; John C. Bacoch

(57) ABSTRACT

A combination includes an electronic device and an electrical connector. The electronic device includes a device housing with a mating area, and a device terminal set formed in the mating area. The electrical connector includes a connector casing with a mating region, a connector terminal set to mate with the device terminal set, and an auxiliary unit with an abutment part covering a part of the mating region of the connector casing. When the mating region of the electrical connector mates with the mating area of the electronic device, the abutment part of the auxiliary unit abuts against the device housing such that the electrical connector is stabilized and prevented from moving relative to the electronic device.

11 Claims, 10 Drawing Sheets

ELECTRICAL CONNECTOR AND COMBINATION OF AN ELECTRONIC DEVICE AND THE ELECTRICAL CONNECTOR

CROSS-REFERENCE TO RELATED APPLICATION

This application claims priority of Taiwanese Application No. 103215735, filed on Sep. 3, 2014.

FIELD OF THE DISCLOSURE

The disclosure relates to an electrical connector, more particularly to a snap-fit electrical connector and a combination of an electronic device and the electrical connector.

BACKGROUND OF THE DISCLOSURE

A conventional electronic device, which is rechargeable or which can transmit signals using a cable, is generally provided with a device terminal set that is exposed from a housing thereof for contacting with a connector terminal set of an external electrical connector. Through this, electrical power or signal can be transmitted. The connector terminal set of the external electrical connector must maintain stable contact with the device terminal set of the electronic device to achieve a good transmission effect.

However, a tolerance usually exists in actual production of an object and the size of the original design. Thus, when the external electrical connector is assembled with the electronic device, because of assembly tolerance, contact between the device terminal set of the electronic device and the connector terminal set of the external electrical connector is poor, especially contact between plate surfaces. For example, as illustrated in FIG. 1, because a gap (G) exists between an assembly of an external electrical connector (an electric charger) 92 and a handheld terminal 91, the gap (G) may cause wobbling of the external electrical connector 92 relative to the handheld terminal 91, so that the device terminal set (not shown) of the external electrical connector 92 cannot stably contact the device terminal set (not shown) of the handheld terminal 91.

SUMMARY OF THE DISCLOSURE

Therefore, an object of the present disclosure is to provide an electrical connector that is capable of overcoming the aforesaid drawback of the prior art.

Another object of the present disclosure is to provide a combination of an electronic device and an electrical connector that is capable of overcoming the aforesaid drawback of the prior art.

According to one aspect of this disclosure, there is provided an electrical connector that includes a connector casing, a connector terminal set, a pair of spaced-apart interlocking structures and an auxiliary unit. The connector casing has a mating region. The connector terminal set protrudes from the mating region of the connector casing. The interlocking structures protrude from the mating region of the connector casing. The connector terminal set is disposed between the interlocking structures. The connector terminal set and the interlocking structures are arranged along a first direction. The auxiliary unit is disposed on the connector casing. The auxiliary unit includes an abutment part that is made of a resilient material and that covers at least a part of the mating region in proximity to the connector terminal set and the interlocking structures.

According to another aspect of the present disclosure, there is provided a combination that includes an electronic device and an electrical connector. The electronic device includes a device housing and a device terminal set. The device housing has a mating area and two spaced-apart interlocking grooves formed in the mating area. The device terminal set is disposed in the mating rear and is situated between the interlocking grooves. The electrical connector includes a connector casing, a connector terminal set, a pair of spaced-apart interlocking structures and an auxiliary unit. The connector casing has a mating region to match with the mating area of the device housing. The connector terminal set protrudes from the mating region of the connector casing to mate with the device terminal set. The interlocking structures protrude from the mating region of the connector casing. The connector terminal set is disposed between the interlocking structures. The connector terminal set and the interlocking structures are arranged along a first direction. The interlocking structures are respectively engageable with the interlocking grooves. The auxiliary unit is disposed on the connector casing. The auxiliary unit includes an abutment part that covers at least a part of the mating region of the connector casing in proximity to the connector terminal set and the interlocking structures. When the mating region of the electrical connector mates with the mating area of the electronic device, the abutment part of the auxiliary unit abuts against the device housing such that the electrical connector is stabilized and prevented from moving relative to the electronic device.

BRIEF DESCRIPTION OF THE DRAWINGS

Other features and advantages of the present disclosure will become apparent in the following detailed description of the embodiment with reference to the accompanying drawings, of which.

DETAILED DESCRIPTION OF THE EMBODIMENT

Figure 1:
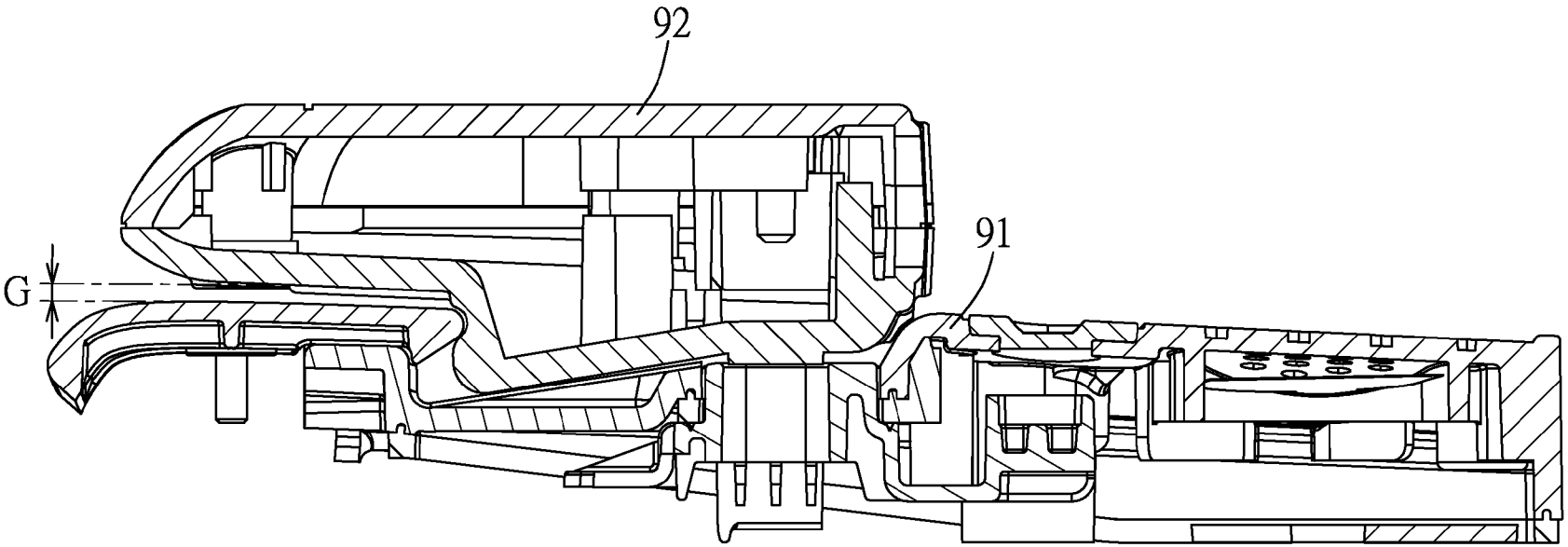
FIG. 1 PRIOR ART
FIG. 1 is an assembled sectional view of a conventional handheld terminal and an external electrical connector.
Figure 2:
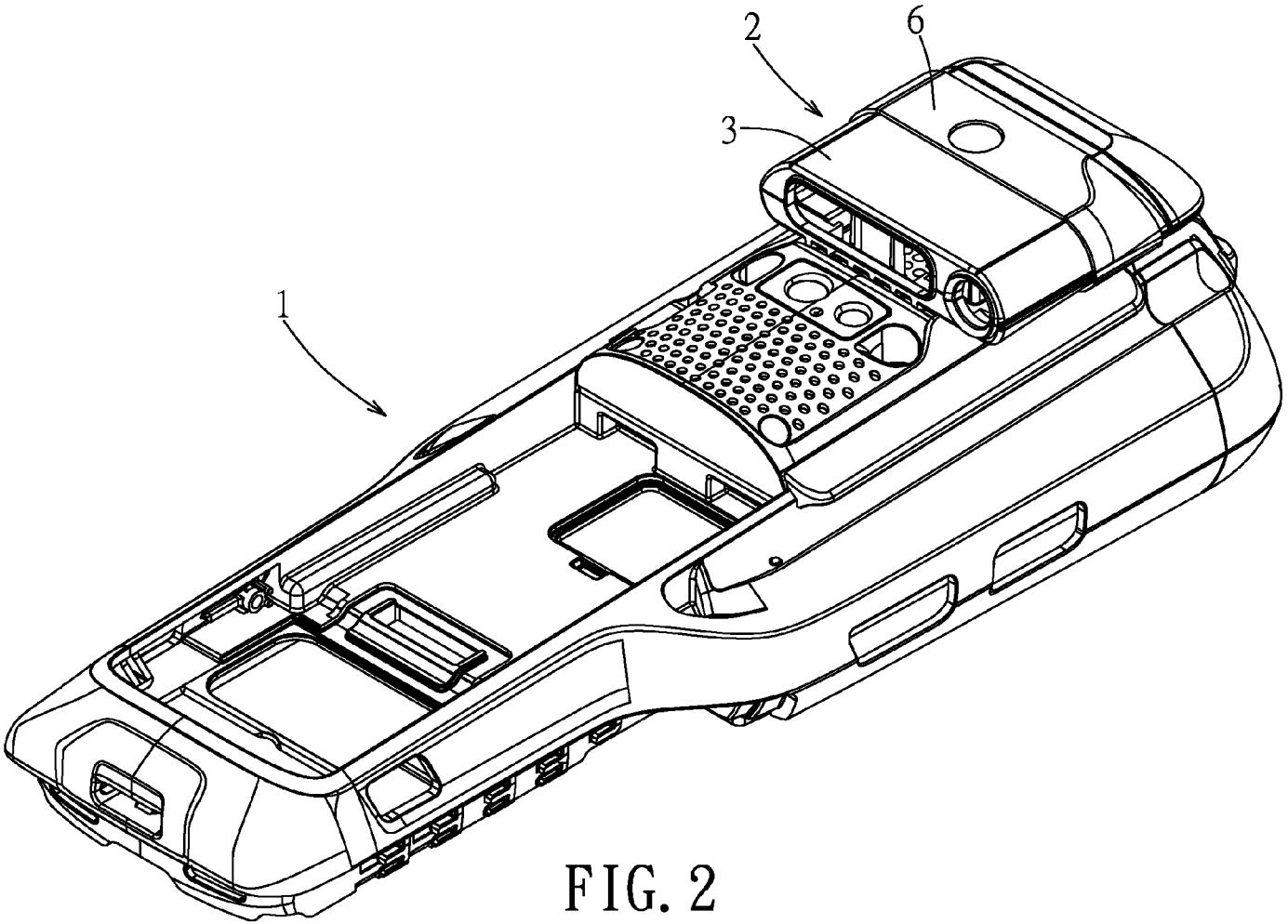
FIG. 2 is a perspective view of a combination of an electronic device and an electrical connector according to the embodiment of the present disclosure.
Figure 3:
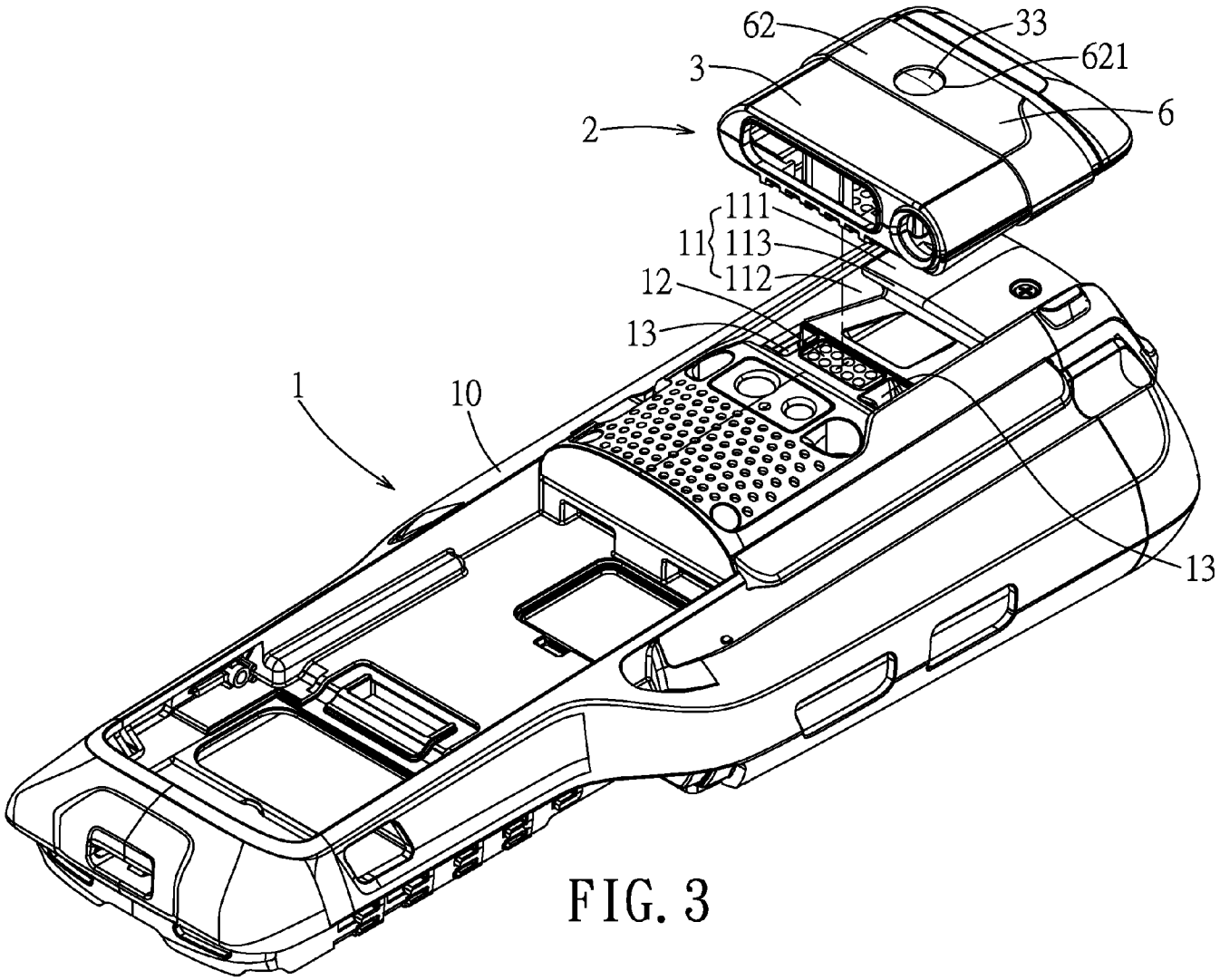
FIG. 3 is an exploded perspective view of the electronic device and the electrical connector of the embodiment.
Figure 4:
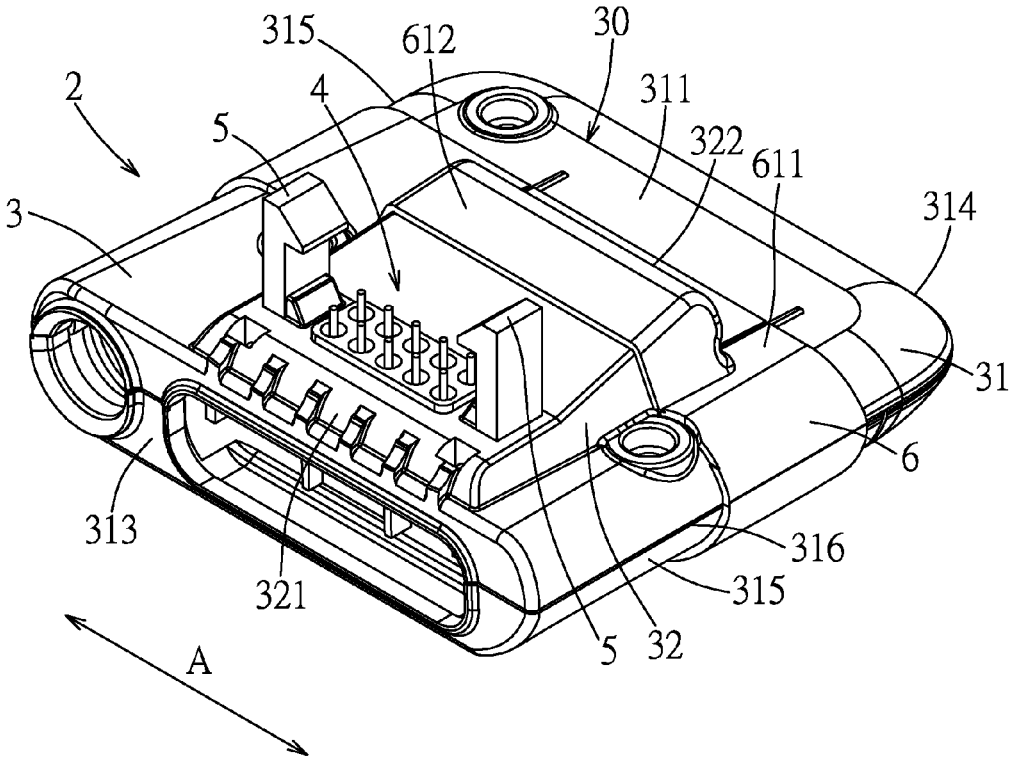
FIG. 4 is a perspective view of the electrical connector of the embodiment.
Figure 5:
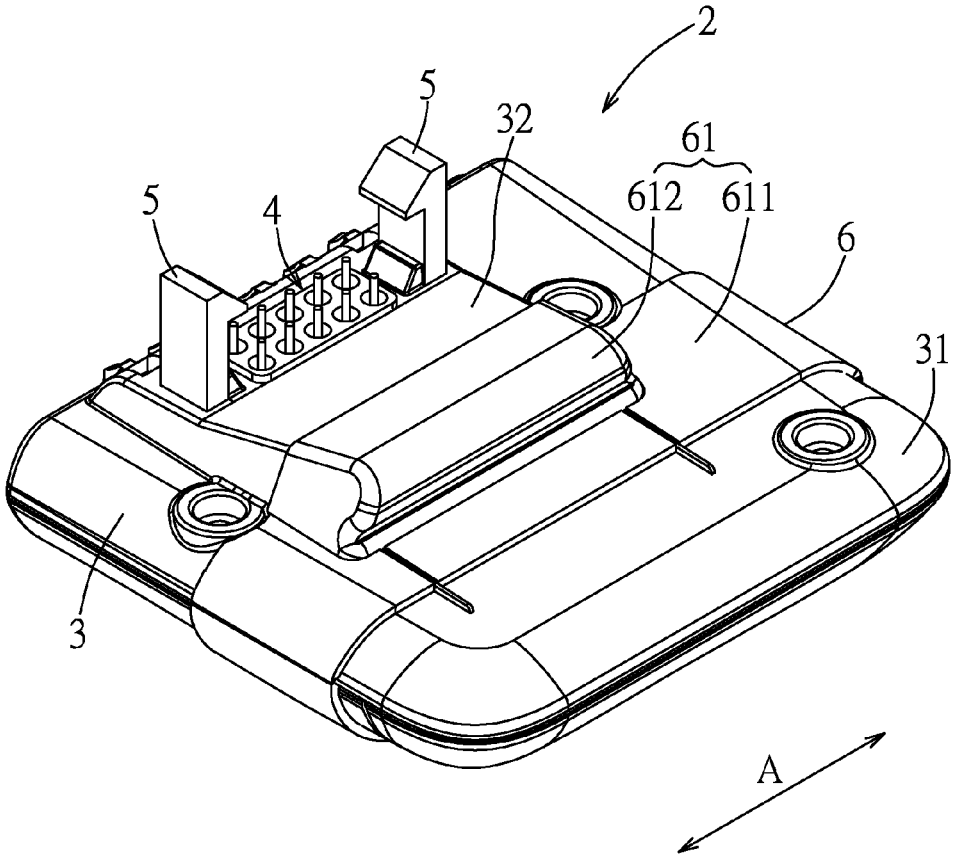
FIG. 5 is a view similar to FIG. 4, but taken from another angle.
Figure 6:
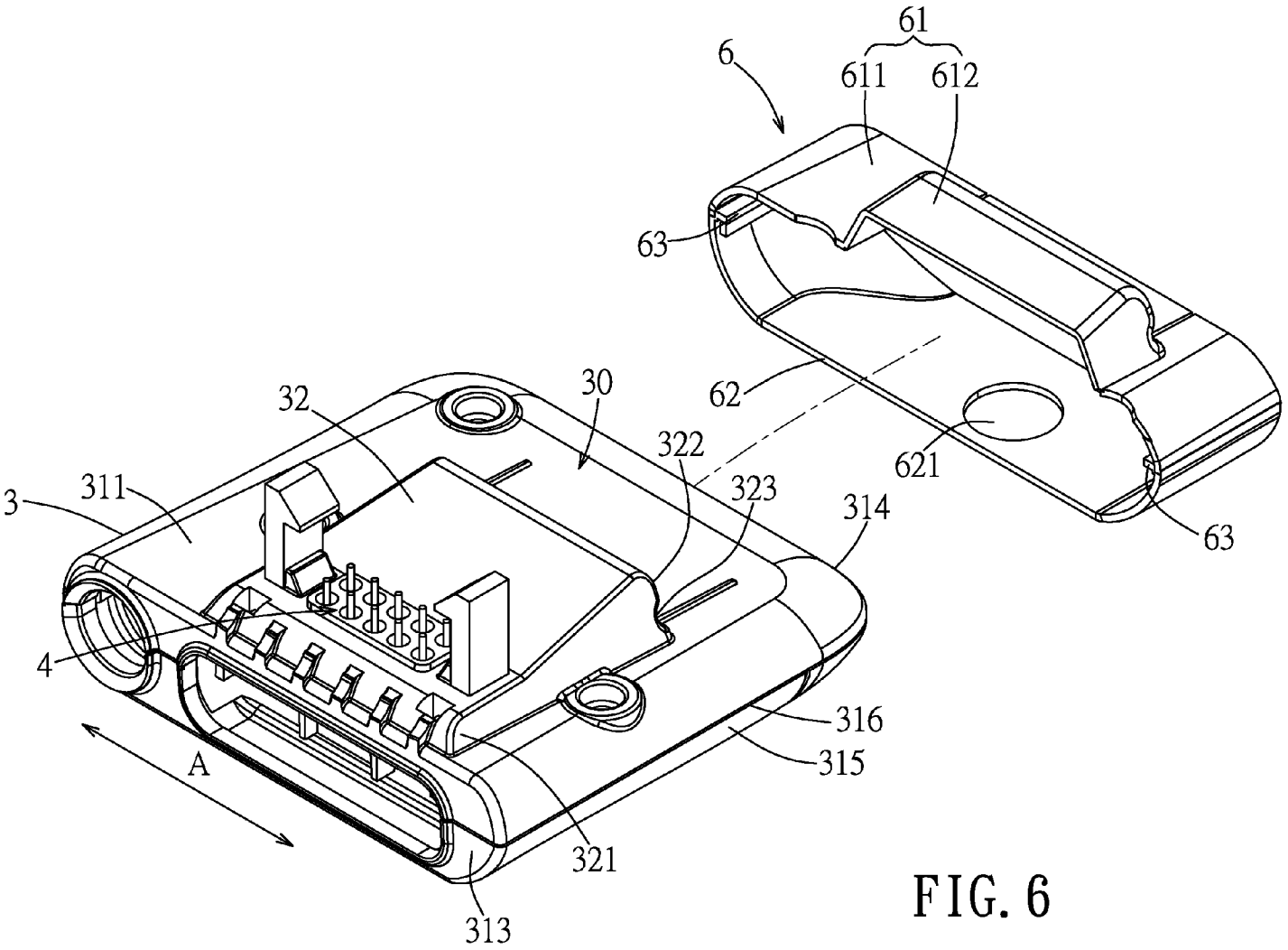
FIG. 6 is an exploded perspective view of the electrical connector of the embodiment.
Figure 7:
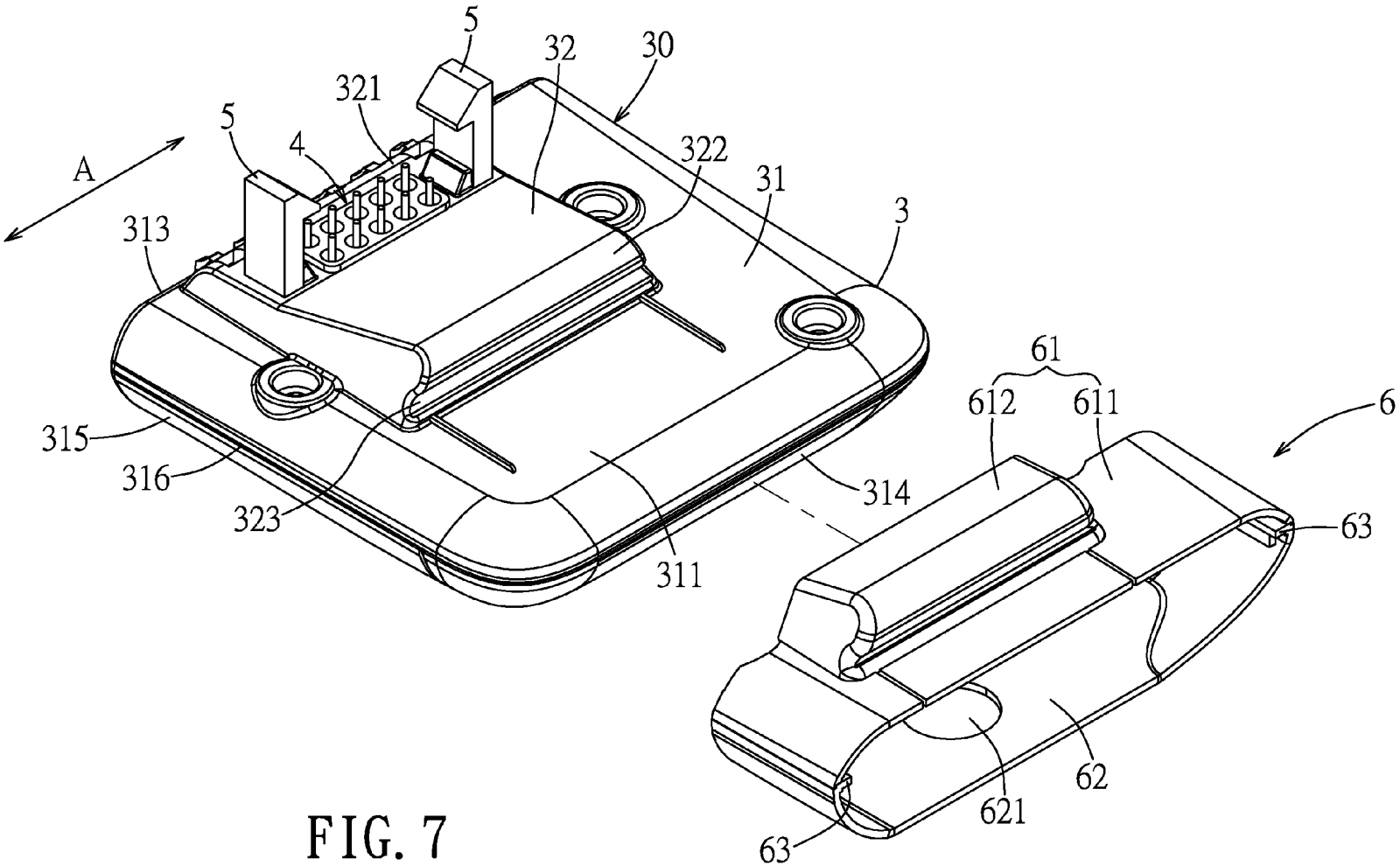
FIG. 7 is a view similar to FIG. 6, but taken from another angle.
Figure 8:
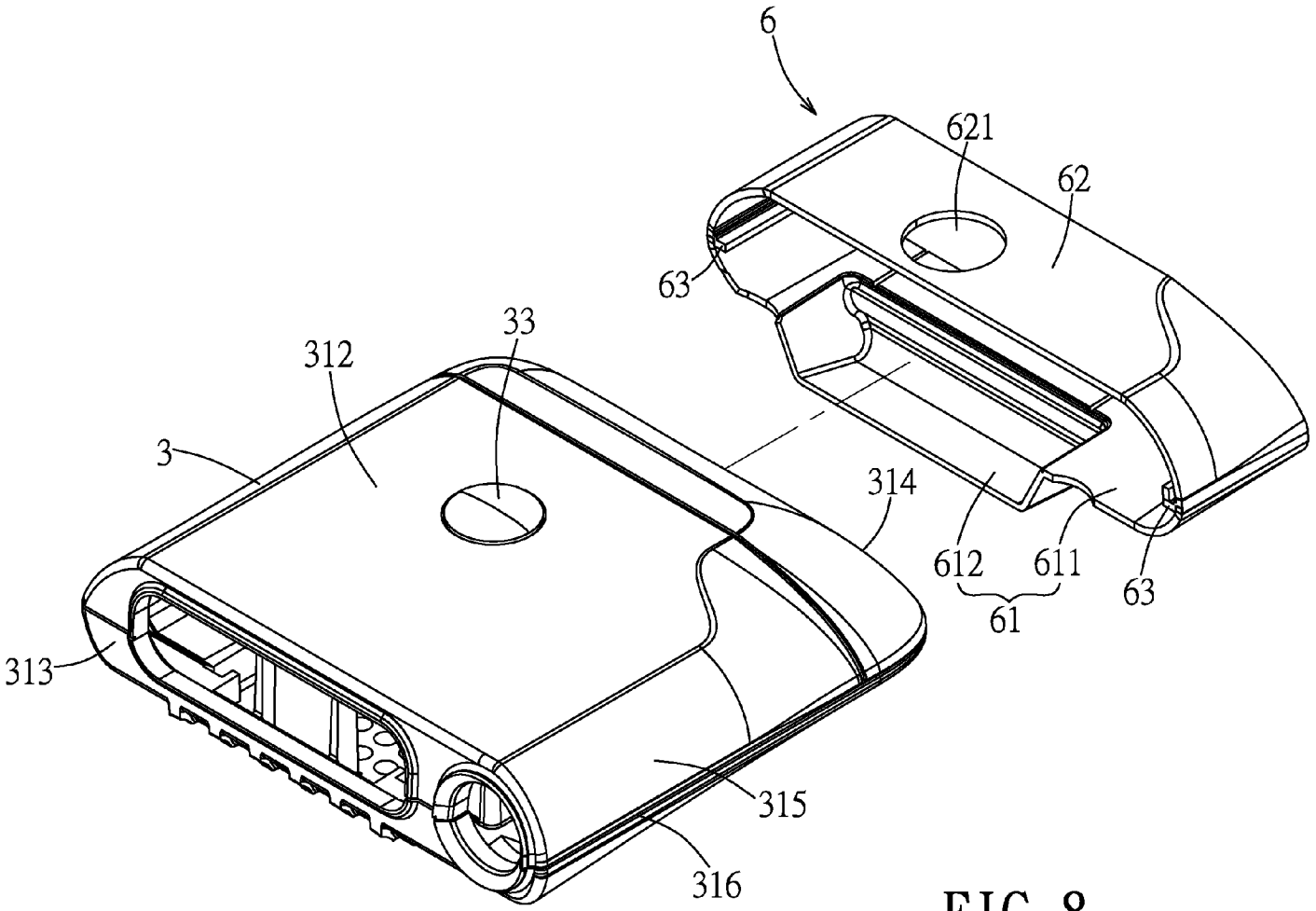
FIG. 8 is a view similar to FIG. 6, but taken from another angle.

FIGS. 2 and 3 illustrate an embodiment of a combination according to the present disclosure. The combination includes an electronic device 1 and an electrical connector 2. In this embodiment, the electronic device 1 is configured as a handheld terminal, while the electrical connector 2 is configured as a charger connected with a cable (not shown). The other end of the cable is connected with a plug (not shown) to connect the electronic device 1 to an external power supply for charging the electronic device 1.

The electronic device 1 includes a device housing 10 and a device terminal set 12. The device housing 10 has a mating area 11, and two spaced-apart interlocking grooves 13 formed in the mating area 11. The mating area 11 has a planar portion 111, a concaved portion 112 and a flange 113 that projects from the planar portion 111 to the concaved portion 112. In this embodiment, the interlocking grooves 13 and the device terminal set 12 are disposed in the concaved portion 112 of the mating area 11. Specifically, the device terminal set 12 is situated between the interlocking grooves 13.

With further reference to FIGS. 4 to 8, the electrical connector 2 includes a connector casing 3, a connector terminal set 4, a pair of spaced-apart interlocking structures 5 and an auxiliary unit 6. The connector casing 3 has a plate-like casing body 31, and a mating protrusion 32 that protrudes from the casing body 31. The casing body 31 has a first plate surface 311, a second plate surface 312 that is opposite to the first plate surface 311, opposite first and second side edges 313, 314 which are parallel with a first direction (A), and two opposite third side edges 315. Each of the first and second side edges 313, 314 is connected between the first and second plate surfaces 311, 312. Additionally, the connector casing 3 further has a projection 33 that projects from the second plate surface 312 of the casing body 31 (see FIG. 8). Each of the third side edges 315 has two opposite ends that are respectively connected to the first and second side edges 313, 314, and a gap 316 that extends along a length thereof. The mating protrusion 32 protrudes from the first plate surface 311, and is proximate to the first side edge 313 and distal to the second side edge 314. In addition, the mating protrusion 32 has first and second engagement sides 321, 322 that are parallel with the first direction (A). The first engagement side 321 is proximate to the first side edge 313. The mating protrusion 32 thickens from the first engagement side 321 toward the second engagement side 322. Specifically, the mating protrusion 32 further has a recess 323 that is formed in the second engagement side 322 and that extends parallel with the first direction (A). The first plate surface 311 and the mating protrusion 32 cooperatively confine a mating region 30 to match with the mating area 11 of the device housing 10. In this embodiment, the concaved portion 112 complementarily receives the mating protrusion 32. The flange 113 of the device housing 10 engages the recess 323 of the mating protrusion 32.

The connector terminal set 4 protrudes from the mating region 30 of the connector casing 3 to mate with the device terminal set 12. In this embodiment, the connector terminal set 4 includes a male terminal set, and the device terminal set 12 includes a female terminal set.

The interlocking structures 5 protrude outwardly from the mating region 30 of the connector casing 3. The connector terminal set 4 is disposed between the interlocking structures 5. In addition, the connector terminal set 4 and the interlocking structures 5 are arranged along the first direction (A) and are disposed on the mating protrusion 32. In this embodiment, the interlocking structures 5 are substantially configured as hooks, and are respectively engageable with the interlocking grooves 13 of the device housing 10 to prevent the electrical connector 2 from separating from the electronic device 1.

The auxiliary unit 6 is disposed on the connector casing 3. In this embodiment, the auxiliary unit 6 is a sleeve ring made of the resilient material, such as a rubber material, and is sleeved around the connector casing 3. The auxiliary unit 6 includes an abutment part 61, a connection part 62 that is connected to the abutment part 61 to form the sleeve ring, and two opposite ribs 63 that protrude inwardly and respectively from two opposite junctions of the abutment part 61 and the connection part 62. The abutment part 61 covers at least a part of the mating region 30 of the connector casing 3 in proximity to the connector terminal set 4 and the interlocking structures 5. Specifically, the abutment part 61 has a strap portion 611 and a cover portion 612 that are connected to each other. The strap portion 611 covers a part of the first plate surface 311 which is adjacent to the mating protrusion 32 and is connected to the connection part 62. The cover portion 612 is complementary in shape to and covers apart of the mating protrusion 32 which has the second engagement side 322 (see FIG. 7). In other words, the abutment part 61 covers the part of the mating protrusion 32 which has the second engagement side 322 and the part of the first plate surface 311 which is adjacent to the second engagement side 322. The strap portion 611 abuts against the planar portion 111 of the mating area 11 of the device housing 10. The cover portion 612 acts upon the mating protrusion 32 which has the second engagement side 322 to position the abutment part 61 relative to the connector casing 3, thereby preventing the abutment part 61 from movement. The connection part 62 extends over the second plate surface 312 of the connector casing 3, and has a through hole 621 that is aligned to the projection 33 to engage the same (see FIG. 8). The ribs 63 respectively engage the gaps 316 of the third side edges 315 so as to enhance the positioning effect of the auxiliary unit 6 relative to the casing 3. When the auxiliary unit 6 is assembled to the connector casing 3, the auxiliary unit 6 is sleeved on the connector casing 3 from the second side edge 314 toward the first side edge 313 with the ribs 63 respectively engaging and sliding along the gaps 316 of the third side edges 315 until the cover portion 612 covers the part of the mating protrusion 32 and the through hole 621 engages the projection 33.

Figure 9:
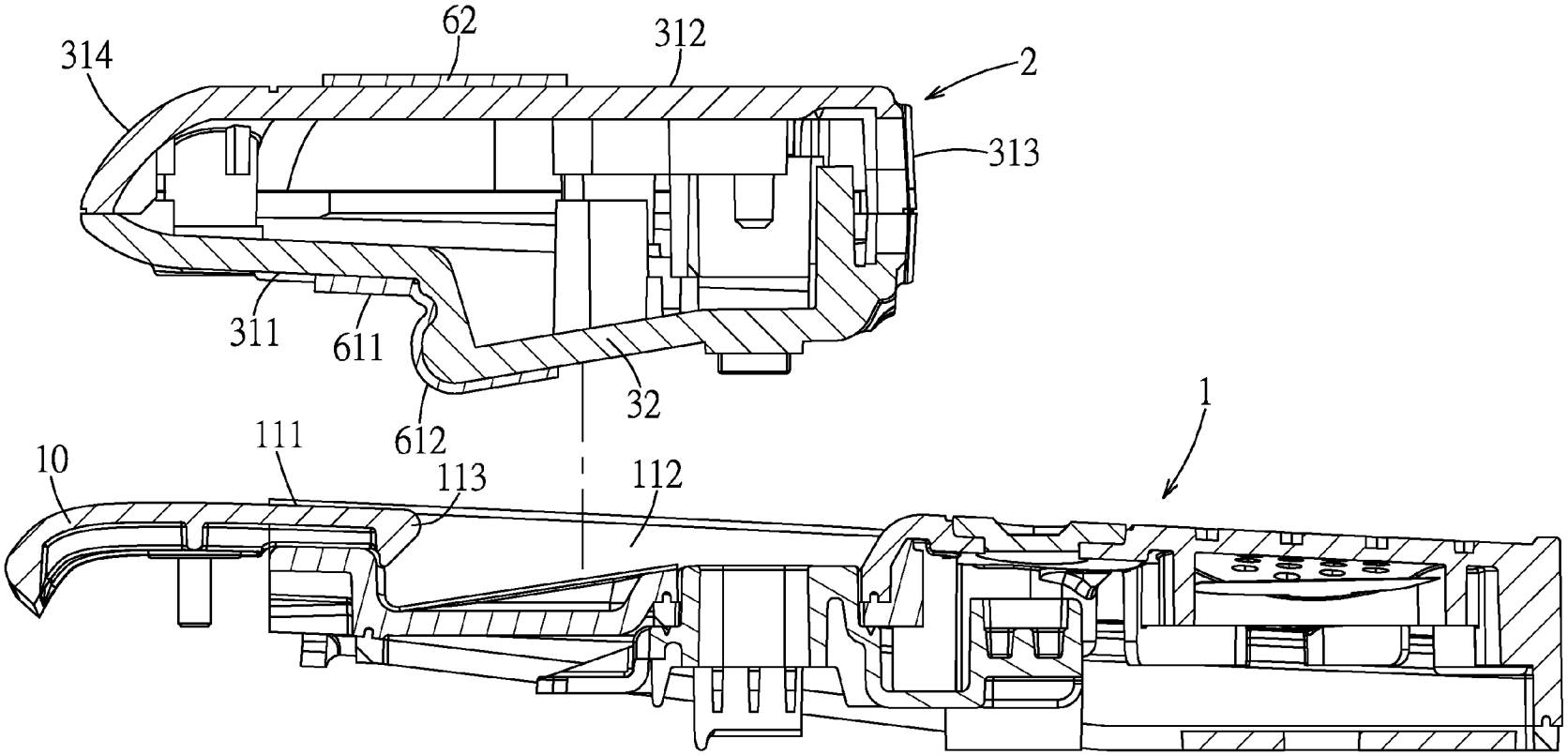
FIG. 9 is an exploded sectional view of the electronic device and the electrical connector of the embodiment.
Figure 10:
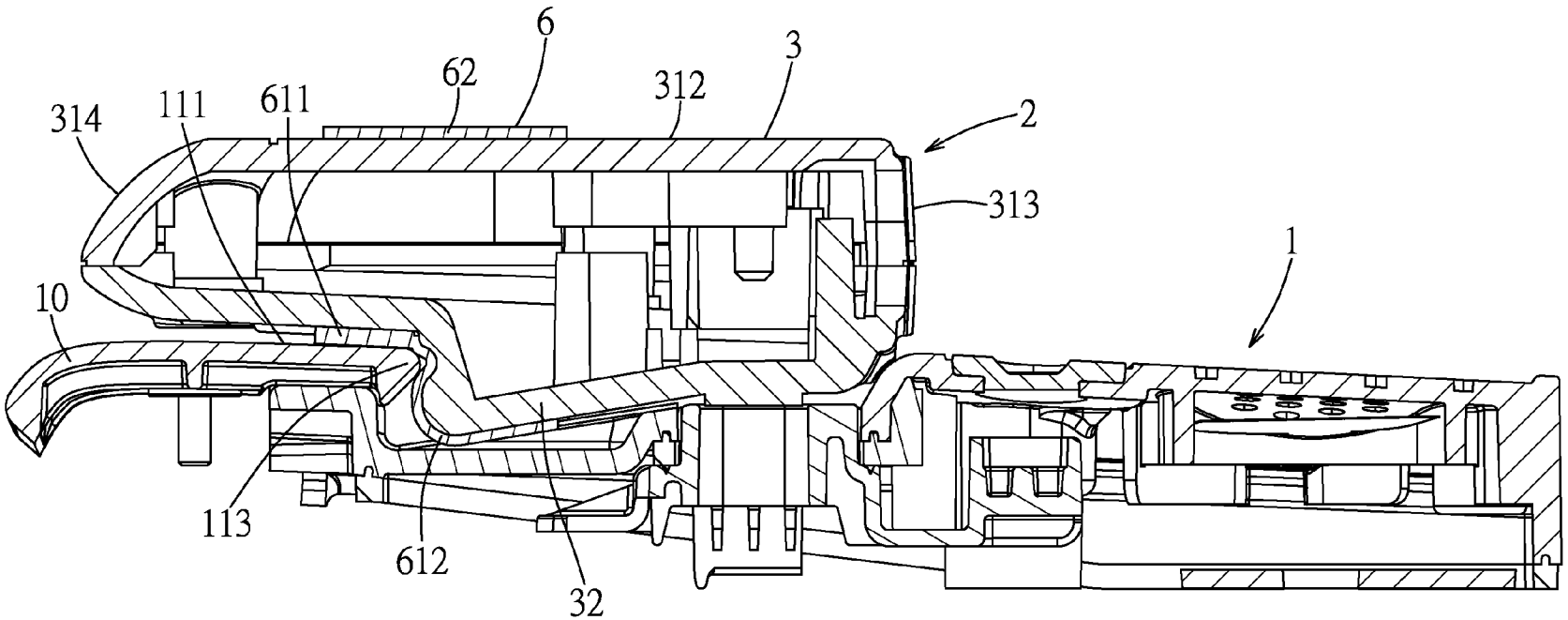
FIG. 10 is an assembled sectional view of FIG. 9.

Referring to FIGS. 9 and 10, in combination with FIG. 2, when the electrical connector 2 mates with the electronic device 1, the strap portion 611 of the abutment part 61 of the auxiliary unit 6 abuts against the planar portion 111 of the device housing 10. Because the abutment part 61 is resilient, the abutment part 61 is capable of occupying a gap between the electrical connector 2 and the electronic device 1, thereby offsetting an assembly tolerance between the electrical connector 2 and the electronic device 1. Further, the abutment part 61 interferes with the electronic device 1, so that the electrical connector 2 is stabilized and prevented from moving relative to the electronic device 1. Accordingly, not only can the device terminal set 12 (see FIG. 3) be firmly and electrically connected to the connector terminal set 4 (see FIG. 4), but also the terminals of the connector terminal set 4 and the interlocking structures 5 (see FIG. 4) can be prevented from being damaged due to the relative movement between the electrical connector 2 and the electronic device 1.

Furthermore, since the auxiliary unit 6 is resiliently disposed on the connector casing 3, the auxiliary unit 6 is simply added to an existing product to eliminate the assembly tolerance between the electrical connector 2 and the electronic device 1 and to prevent relative movement between the same. As such, there is no need to alter the original structural design of the existing product. Hence, the manufacturing costs associated therewith can be greatly saved.

To sum up, through the auxiliary unit 6 which can eliminate the assembly tolerance and which can prevent relative movement between the electrical connector 2 and the electronic device 1, not only can the device terminal set 12 be firmly and electrically connected to the connector terminal set 4, but also the terminals of the connector terminal set 4 and the interlocking structures 5 (see FIG. 4) can be prevented from being damaged due to the relative movement between the electrical connector 2 and the electronic device 1. Moreover, the auxiliary unit 6 is simply added to an existing product to eliminate the assembly tolerance between the electrical connector 2 and the electronic device 1 and to prevent relative movement between the same, so that there is no need to alter the original structural design of the existing product. Hence, the manufacturing costs associated therewith can be greatly saved.

While the present disclosure has been described in connection with what is considered the most practical embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electrical connector, comprising:

a connector casing having a mating region, a plate-like casing body, and a mating protrusion that protrudes from said casing body, said casing body having a first plate surface on which said mating region is provided, a second plate surface opposite to said first plate surface, and opposite first and second side edges which are parallel with the first direction and each of which is connected between said first and second plate surfaces, said mating protrusion protruding from said first plate surface and being proximate to said first side edge and distal to said second side edge;

a connector terminal set protruding from said mating region of said connector casing;

a pair of spaced-apart interlocking structures protruding from said mating region of said connector casing, said connector terminal set being disposed between said interlocking structures, said connector terminal set and said interlocking structures being arranged along a first direction and being disposed on said mating protrusion; and an auxiliary unit disposed on said connector casing and including an abutment part that is made of a resilient material and that covers at least a part of said mating region in proximity to said connector terminal set and said interlocking structures, said abutment part covering said first plate surface and abutting with said mating protrusion.

2. The electrical connector as claimed in claim 1, wherein said mating protrusion of said connector casing has first and second engagement sides that are parallel with the first direction, said first engagement side being proximate to said first side edge of said casing body, said mating protrusion thickening from said first engagement side toward said second engagement side, said mating protrusion further having a recess that is formed in said second engagement side and that extends parallel with the first direction, said abutment part of said auxiliary unit covering a part of said mating protrusion which has said second engagement side and a part of said first plate surface which is adjacent to said second engagement side.

3. The electrical connector as claimed in claim 2, wherein said auxiliary unit is a sleeve ring made of the resilient material and further includes a connection part that is connected to said abutment part to form said sleeve ring and that extends over said second plate surface, said abutment part having a strap portion and a cover portion that are connected to each other, said strap portion covering said part of said first plate surface which is adjacent to said mating protrusion, said cover portion being complementary in shape to and covering said part of said mating protrusion which has said second engagement side.

4. The electrical connector as claimed in claim 3, wherein said connector casing further has a projection that projects from said second plate surface of said casing body, said connection part of said auxiliary unit having a through hole that is aligned to said projection and that engages to said projection.

5. The electrical connector as claimed in claim 3, wherein said casing body further has two opposite third side edges, each of said third side edges having two opposite ends that are respectively connected to said first and second side edges, and a gap that extends along a length thereof, said auxiliary unit further having two opposite ribs that protrude respectively from two opposite junctions of said abutment part and said connection part and that respectively engage said gaps of said third side edges.

6. The electrical connector as claimed in claim 1, wherein said auxiliary unit is a sleeve ring that is sleeved around said connector casing.

7. A combination comprising:

an electronic device including a device housing that has a mating area and two spaced-apart interlocking grooves formed in said mating area, and a device terminal set that is disposed in said mating rear and that is situated between said interlocking grooves; and an electrical connector including a connector casing having a mating region to match with said mating area of said device housing, a plate-like casing body, and a mating protrusion that protrudes from said casing body, said casing body having a first plate surface on which said mating region of said connector casing is provided, a second plate surface opposite to said first plate surface, and first and second side edges which are parallel with the first direction and each of which is connected between said first and second plate surfaces, said mating protrusion protruding from said first plate surface and being proximate to said first side edge and distal to said second side edge, a connector terminal set protruding from said mating region of said connector casing to mate with said device terminal set, a pair of spaced-apart interlocking structures protruding from said mating region of said connector casing, said connector terminal set being disposed between said interlocking structures, said connector terminal set and said interlocking structures being arranged along a first direction and being disposed on said mating protrusion, said interlocking structures being respectively engageable with said interlocking grooves, an auxiliary unit disposed on said connector casing and including an abutment part that covers at least a part of said mating region of said connector casing in proximity to said connector terminal set and said interlocking structures, said abutment part covering said first plate surface and abutting with said mating protrusion, wherein said mating area of said device housing has a planar portion and a concaved portion that complementarily receives said mating protrusion; and wherein, when said mating region of said electrical connector mates with said mating area of said electronic device, said abutment part of said auxiliary unit abuts against said planar portion such that said electrical connector is stabilized and prevented from moving relative to said electronic device.

8. The combination as claimed in claim 7, wherein said mating protrusion of said connector casing has first and second engagement sides that are parallel with the first direction, said first engagement side being proximate to said first side edge of said casing body, said mating protrusion thickening from said first engagement side toward said second engagement side, said mating protrusion further having a recess that is formed in said second engagement side and that extends parallel with the first direction, said abutment part of said auxiliary unit covering a part of said mating protrusion which has said second engagement side and a part of said first plate surface which is adjacent to said second engagement side, said mating area of said device housing further having a flange that projects from said planar portion to said concaved portion, said flange engaging said recess of said mating protrusion.

9. The combination as claimed in claim 8, wherein said auxiliary unit is a sleeve ring made of the resilient material and further includes a connection part that is connected to said abutment part to form said sleeve ring and that extends over said second plate surface, said abutment part having a strap portion and a cover portion that are connected to each other, said strap portion covering said part of said first plate surface which is adjacent to said mating protrusion, said cover portion being complementary in shape to and covering said part of said mating protrusion which has said second engagement side.

10. The electronic assembly as claimed in claim 9, wherein said connector casing further has a projection that projects from said second plate surface of said casing body, said connection part of said auxiliary unit having a through hole that is aligned to said projection and that engages said projection.

11. The electronic assembly as claimed in claim 9, wherein said casing body further has two opposite third side edges, each of said third side edges having two opposite ends that are respectively connected to said first and second side edges, and a gap that extends along a length thereof, said auxiliary unit further having two opposite ribs that protrude respectively from two opposite junctions of said abutment part and said connection part and that respectively engage said gaps of said third side edges.

* * * * *